US005492282A

United States Patent [19]

Okuchi et al.

[11] Patent Number: 5,492,282

[45] Date of Patent: Feb. 20, 1996

[54] REFILLABLE TAPE CASSETTES OF VARYING THICKNESSES WITH UNIQUE SPOOL MOUNTING STRUCTURES

[75] Inventors: Hiroyuki Okuchi; Takamitsu Kawai, both of Nagoya; Koshiro Yamaguchi, Kasugai, all of Japan

[73] Assignee: Brother Kogyo Kabushiki Kaisha, Aichi, Japan

[21] Appl. No.: 257,144

[22] Filed: Jun. 9, 1994

[30] Foreign Application Priority Data

Jun. 15, 1993 [JP] Japan ..... 5-168572

[51] Int. Cl.[6] ..... B41J 35/28

[52] U.S. Cl. ..... 242/341; 242/345; 242/347.2; 242/336; 400/208.1

[58] Field of Search ..... 242/335, 336, 242/341, 342, 345, 347, 347.1, 347.2, 348, 348.3; 400/207, 207 E, 208, 208.1

[56] References Cited

U.S. PATENT DOCUMENTS

| | | | |
|---|---|---|---|
| 4,367,963 | 1/1983 | Daughters | 242/347.2 |
| 4,526,330 | 7/1985 | Shimizu | 242/347 |
| 4,531,690 | 7/1985 | Condy | 400/208 |
| 4,555,077 | 11/1985 | Platter et al. | 242/338.1 |
| 4,605,325 | 8/1986 | Hofmann | 400/207 |
| 4,836,698 | 6/1989 | Takagi et al. | 400/208 |
| 4,927,278 | 5/1990 | Kuzuya et al. | 400/208 |
| 5,022,771 | 6/1991 | Paque | 400/120 |
| 5,073,052 | 12/1991 | Daley et al. | 400/208 |
| 5,277,503 | 1/1994 | Nagao | 242/336 |
| 5,332,174 | 7/1994 | Cook | 242/348 |

FOREIGN PATENT DOCUMENTS

| | | |
|---|---|---|
| 0447786A2 | 9/1991 | European Pat. Off. . |
| 0467414A2 | 1/1992 | European Pat. Off. . |
| 0625427A2 | 11/1994 | European Pat. Off. . |

*Primary Examiner*—John P. Darling
*Attorney, Agent, or Firm*—Oliff & Berridge

[57] ABSTRACT

A tape cassette capable of refilling a tape among various tapes each having width different from one another into a corresponding tape cassette, and capable of properly refilling the tape into a corresponding tape cassette without fail. In a broad width tape cassette, a first annular space is provided between an inner diameter of a tape spool and an outer diameter of a tape support shaft. A first cap is fitted into the first space. In a small width tape cassette, a second annular space is provided between an inner diameter of a tape spool and an outer diameter of a tape support shaft. A second cap is fitted into the second space. A tape spool can be correctly refilled into corresponding tape cassette by checking insertion of the caps into the spaces.

19 Claims, 8 Drawing Sheets

REFILLABLE TAPE CASSETTES OF VARYING THICKNESSES WITH UNIQUE SPOOL MOUNTING STRUCTURES

BACKGROUND OF THE INVENTION

The present invention relates to a tape cassette installable in a tape printer, and more particularly, to the tape cassette in which a new tape roll can be repacked or refilled in a cassette case, and a repacking of the tape roll in the cassette case can be performed by only using the correct tape kind.

The tape printer can produce a character-printed tape to be affixed to a backbone of a video cassette, etc. Conventionally, in tape cassettes for use in the tape printer, a plurality of tapes each having width different from one another are required to meet with various use of character-printed tapes produced by the tape printer. To this effect, various kind of tape cassettes are prepared for installing, in each of the cassette cases, each tape of different width. In such conventional tape cassettes, repacking of a new tape in the cassette case has not been considered when the tape in the cassette case is used up. Therefore, when the tape is used up, the cassette case has a reduced value, and it is discarded.

However, in the conventional tape cassette, even in a case where the tape in the cassette case is used up, the cassette case per se is still usable. Therefore, mere abandonment of the tape cassette for the reason of use-up of the tape is extremely wasteful, and the tape cassette becomes costly. Further, in light of recent trend of the protection of environment, a throw-away of the cassette case each time after the use-up of the tape may violate the protection of environment, since the cassette case is made of a resin material such as plastics.

SUMMARY OF THE INVENTION

It is therefore, an object of the present invention to overcome the above described conventional drawbacks, and to provide a tape cassette capable of repacking a new tape roll into a cassette case, to thereby avoid any waste in making a character-printed tape, to thus reduce entire running cost.

Another object of the invention is to provide a tape cassette in which repacking of the tape in the cassette case can be properly performed by only using the correct tape kind.

In order to attain the above described object, according to a first aspect of the present invention, there are provided a plurality of different kind of tape cassettes, each tape cassettes comprising a tape spool, a cassette body and a tape support shaft. The tape spool winds thereover a tape, and is formed with a bore defining an inner contour characteristic. The cassette body is adapted for accommodating therein the tape spool and a roll of the tape. The tape support shaft upstands from the cassette body and has an outer contour characteristic. The tape spool is adapted for being rotatably disposed around the tape support shaft through the spool bore. The outer contour characteristic of the tape support shaft of each kind of tape cassette corresponds to the inner contour characteristic of the tape spool bore for the same type of tape cassette, so that a correspondence between the outer and inner contour characteristics provides a relation with respect to an identical kind. The relation is different from that in the different kind of the tape cassette.

In a second aspect of the present invention, there is provided a tame cassette detachably installable into a tape printer comprising a tape spool for winding thereover a tape, a cassette body for accommodating therein the tape spool and a roll of the tape, a support portion for rotatably and detachably supporting the tape spool, and a lid member provided detachably with respect to the cassette body for refilling a new spool winding thereover a new tape.

According to the first aspect of the present invention, when the tape accommodated in the tape cassette body is used up, the tape spool is exchanged with a new tape spool winding thereover a new tape. In this case, the outer contour characteristic of the tape support shaft of each kind of tape cassette corresponds to the inner contour characteristic of the tape spool for the same type of tape cassette. This correspondence provides optimum size relation between the tape support shaft and the tape spool, i.e, not too tight for allowing the tape spool to be still rotatable about the tape support shaft, and not too loose for avoiding rattling of the tape spool against the tape support shaft. Either a non-corresponding tape spool cannot be mounted on a tape support shaft of a cassette body because its inner contour is too small, or alternatively, if mountable, the improper tape spool will rattle after being mounted the tape support shaft because its inner contour is too large. Therefore, the user can notice the improper selection of the tape spool relative to the tape cassette body. Thus, proper tape refilling relative to the corresponding tape cassette is achievable.

If an inner diameter of a first tape spool of a first tape cassette is made equal to an inner diameter of a second tape spool of a second tape cassette, and an outer diameter of a tape support shaft of the first tape cassette is different from an outer diameter of a second tape support shaft of the second tape cassette, a first space is defined between the first tape support shaft and the first tape spool in the first tape cassette and a second space is defined between the second tape support shaft and the second tape spool of the second tape cassette. A first cap member is provided to be fitted in the first space and a second cap member is provided to be fitted in the second space. With the arrangement, only the first cap member can be properly fitted into the first space, and only the second cap member can be properly fitted into the second space. Accordingly, tape spools of the first tape cassette and the second tape cassette are not erroneously filled in the second and the first tape cassette, respectively, and as a result, proper tape refilling relative to the corresponding tape cassette is achievable.

According to the second aspect of the present invention, when the tape wound over the tape spool is used up, the tape spool can be exchanged with a tape spool winding thereover a new tape by simply disassembling the lid from the cassette body. As a result, the tape cassette body can be effectively utilized as much as possible.

DETAILED DESCRIPTION OF THE PREFERRED EMBODIMENTS

Figure 1:
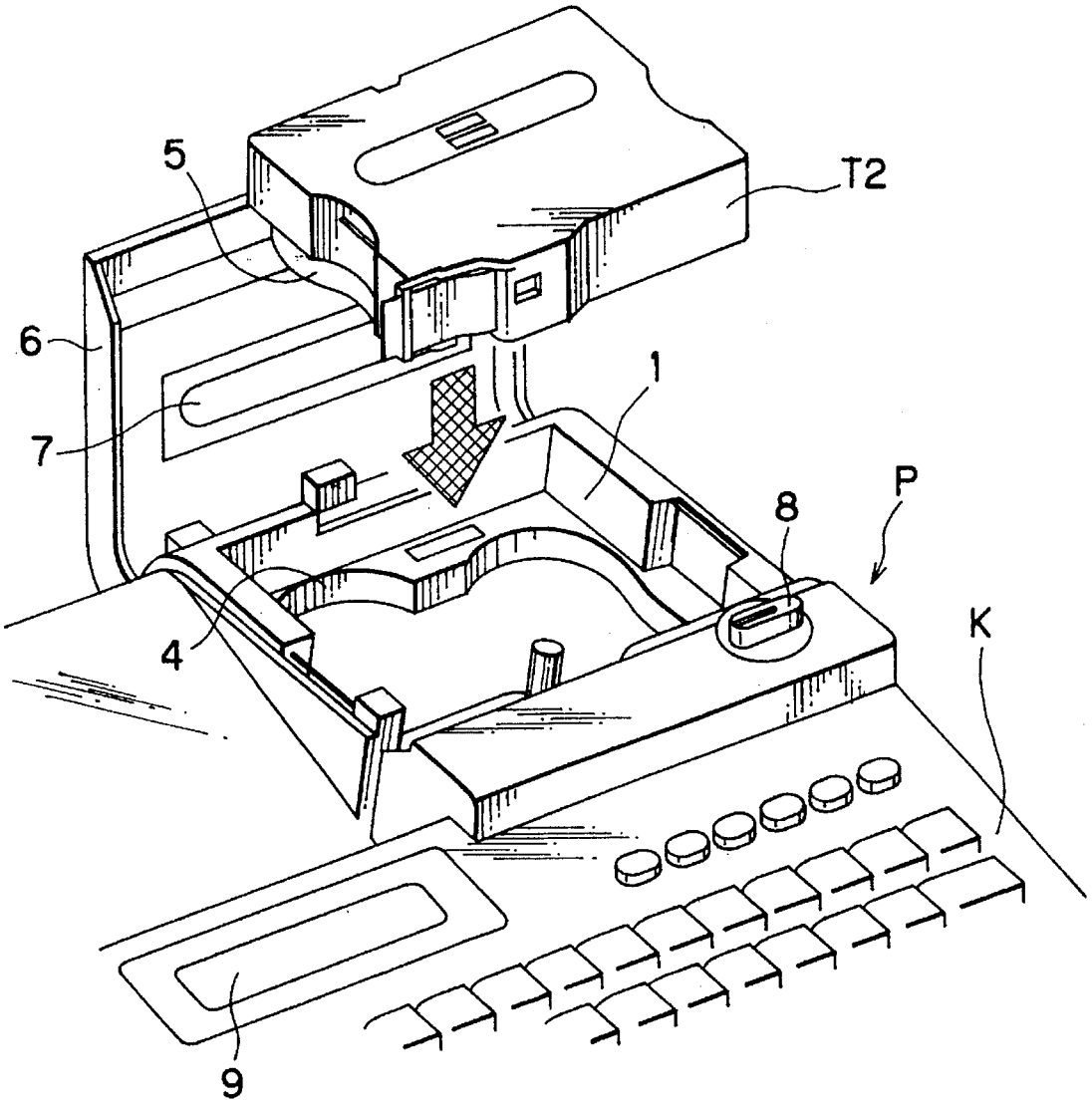
FIG. 1 is a schematic perspective view showing a tape cassette installing portion of a tape printer.
Figure 2:
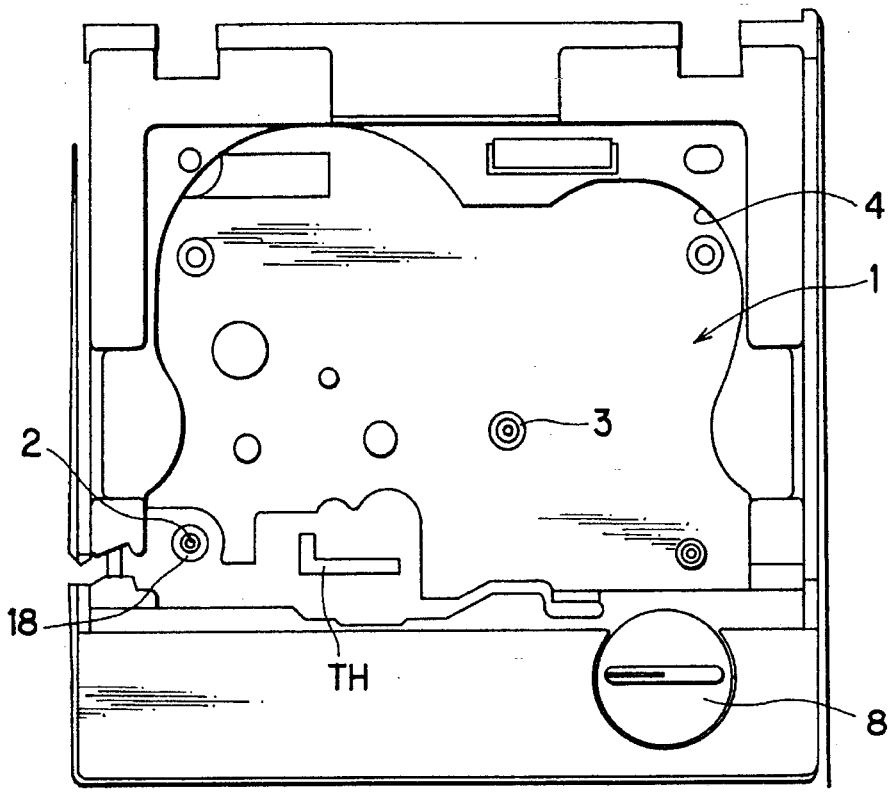
FIG. 2 is an enlarged plan view showing the tape cassette installing portion.

First, a tape printer P which uses a tape cassette of the present invention will be briefly described with reference to FIGS. 1 and 2.

In these drawings, a tape cassette installing portion 1 is provided at a rear right portion of the tape printer P. In the installing portion 1, one of various kinds of tape cassettes is installable. In the illustrated embodiment, two kinds of tape cassettes T1 and T2 are provided. T1 is a tape cassette which accommodates a tape of small width, and T2 is a tape cassette which accommodates a tape of broad width. FIG. 1 shows the broad width tape cassette T2.

The tape cassette installing portion 1 has a lower left side portion at which is provided a tape drive shaft 2 rotatably driven by a tape drive motor (not shown). The tape drive shaft 2 fixes a tape feed shaft 18. The tape feed shaft 18 is engageable with a tape drive roller 19 (described later, see FIG. 5) of the tape cassette. Further, a supplemental tape drive roller (not shown) is provided in the tape installing portion 1. The supplemental tape drive roller is positioned to confront the tape drive roller 19, when the tape cassette is installed in the cassette installing portion 1.

The cassette installing portion 1 has an approximately central portion where is provided a drive shaft 3 rotatable in synchronization with the tape drive shaft 2 through a gear transmission mechanism (not shown). The drive shaft 3 conventionally serves as a take-up shaft for winding a thermal ribbon accommodated in a conventional tape cassette. However, with respect to the tape cassette T1 or T2 in the present embodiment, the drive shaft 3 does not perform driving operation to the tape T, and therefore, the drive shaft 3 is engaged with a silencer spool 20 (described later, see FIG. 5) in order to reduce noise generated by the rotation of the drive shaft 3. Accordingly, the tape T accommodated in the tape cassette T1 or T2 is driven by the tape feed shaft 18 of the tape drive shaft 2, the tape drive roller 19 and the supplemental tape drive roller.

The tape cassette installing portion 1 is formed with a recessed portion 4 (see FIG. 1) adapted to receive therein a projected portion 5 (described later) provided at a bottom of the broad tape cassette T2 when it is installed in the cassette installing portion 1.

The tape cassette installing portion 1 thus constructed has a rear portion where is provided a lid 6 provided pivotable relative to a body of the tape printer P. A window 7 is formed at an approximately center portion of the lid 6 to see through and acknowledge a kind of the tape cassette (either the small width tape cassette T1 or broad width tape cassette T2) installed in the tape cassette installing portion 1. At a position in front of the tape cassette installing portion 1, a rotation lock member 8 is provided which is constituted by a locking mechanism (not shown) for opening and closing the lid 6. Further, a keyboard K which includes various keys is provided in front of the cassette installing portion 1, and a liquid crystal display 9 is provided at a rear of the keyboard K. Thus, editing of characters and marks is carried out on the tape T through a thermal head TH (see FIG. 2), while characters and marks input by the keys of the keyboard K are displayed in the liquid crystal display 9.

Figure 3:
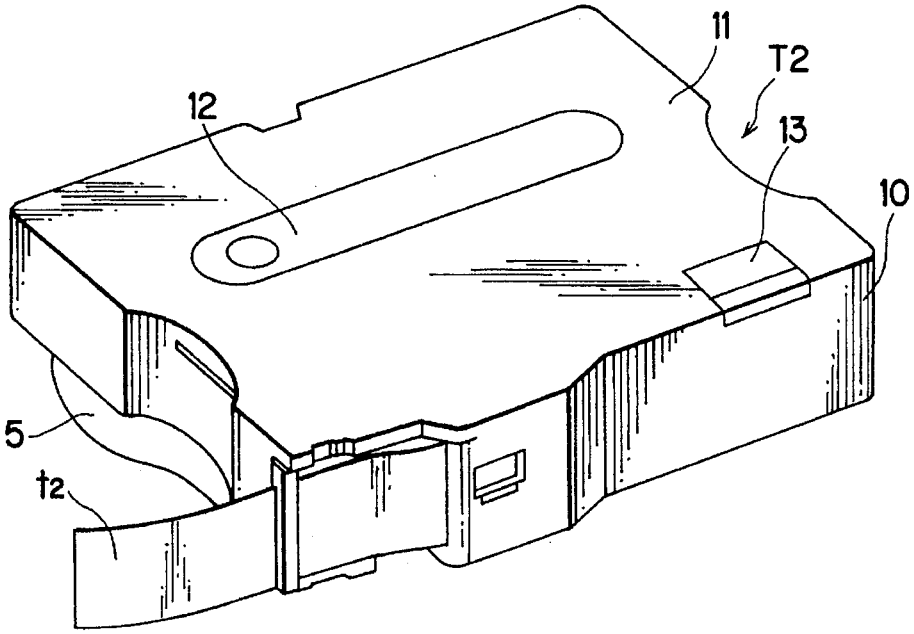
FIG. 3 is a perspective view showing a broad width tape cassette according to a first embodiment of the present invention.
Figure 4:
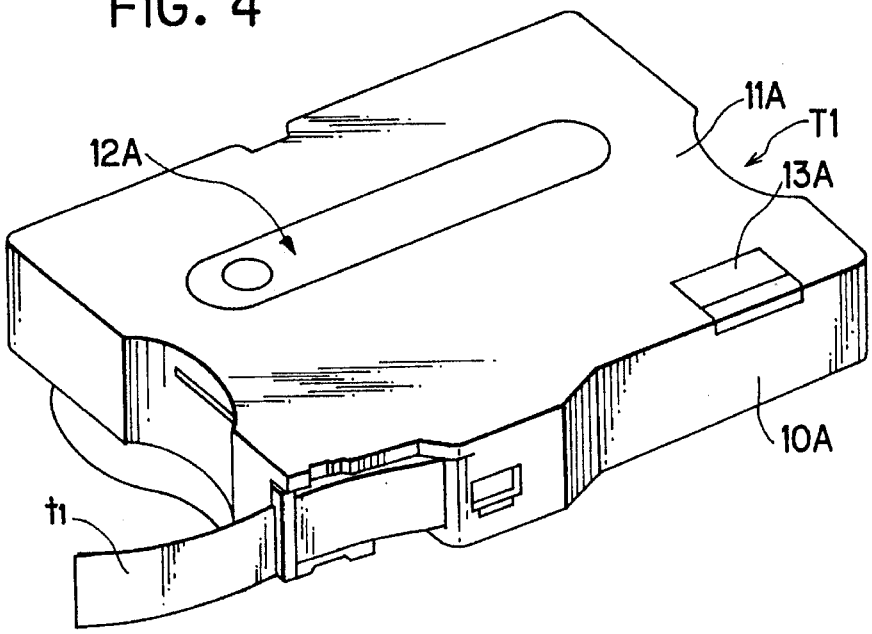
FIG. 4 is a perspective view showing a small width tape cassette according to the first embodiment.

Next, two tape cassettes T1 and T2 in accordance with the first embodiment of the present invention will be described with reference to FIGS. 3 and 4. The broad tape cassette T2 is shown in FIG. 3, and the small width tape cassette T1 is shown in FIG. 4.

Each tape cassette T2, T1 includes a cassette body 10, 10A and a cassette lid 11,11A provided detachably engageable therewith through an engagement portion 13, 13A and a pawl member(not shown), etc. The cassette lid 11,11A has a central portion where is provided a tape acknowledging portion 12,12A formed of a transparent resin plate in correspondence with the window 7 formed at the lid 6 of the tape cassette installing portion 1. Through the window 7 of the lid 6 and the tape acknowledging portion 12, 12A can be observed, from an outside of the tape printer P, an amount of the tape t2, t1 accommodated in the tape cassette T2, T1 color and color density of the character printed in the tape t2,t1. Incidentally, a slot can be formed serving as the tape acknowledging portion 12, 12A for observing an interior of the tape cassette T1 or T2.

With respect to the broad width tape cassette T2, a bottom wall of the cassette body 10 has the projected portion 5 described above. The projected portion 5 is fittable with the recessed portion 4 formed in the cassette installing portion 1. On the other hand, with respect to the small width tape cassette T1, since the width of the tape t1 accommodated in the cassette body 10A is small, contrary to the broad tape cassette T2, a portion corresponding to the projected portion 5 of the broad tape cassette T2 is not provided at the bottom of the small width tape cassette T1. Accordingly, the small width tape cassette T1 is not associated with the recessed portion 4 when installing the cassette T1 into the cassette installing portion 1.

Next, internal construction of each of the broad width tape cassette T2 and the small width tape cassette T1 will be described with reference to FIGS. 5 through 11.

Figure 5:
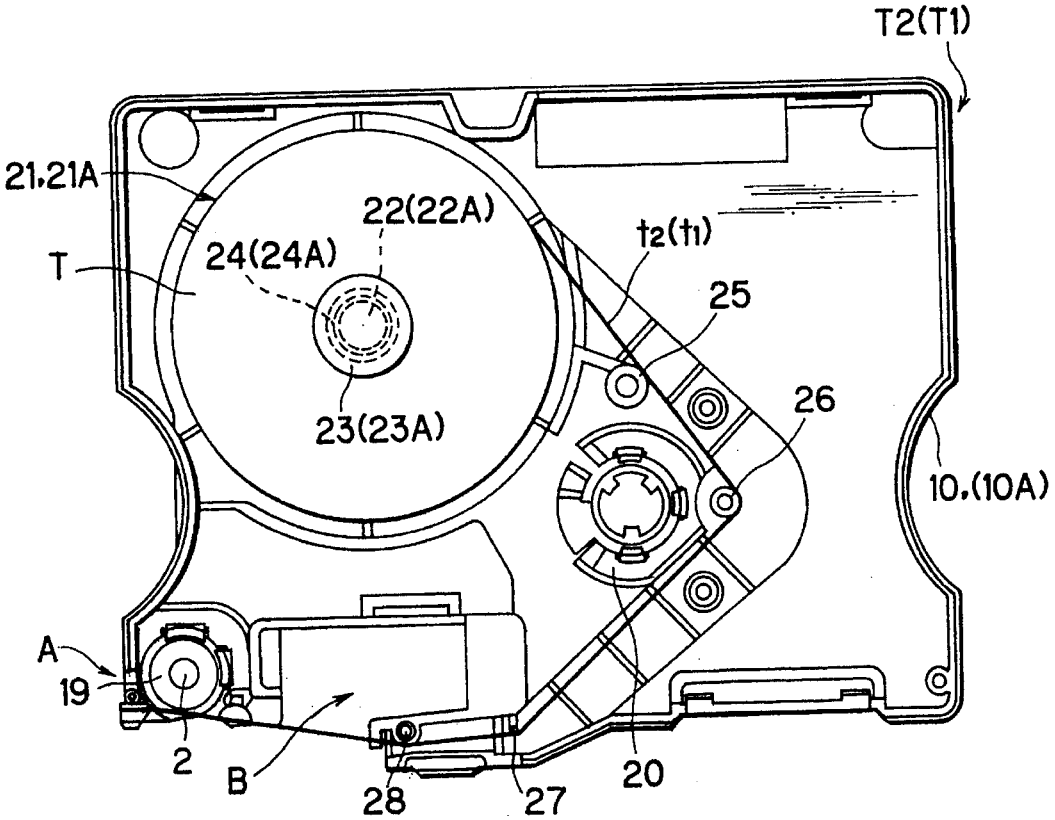
FIG. 5 is a plan view showing a tape cassette whose lid is removed from the drawing according to the first embodiment.
Figure 6:
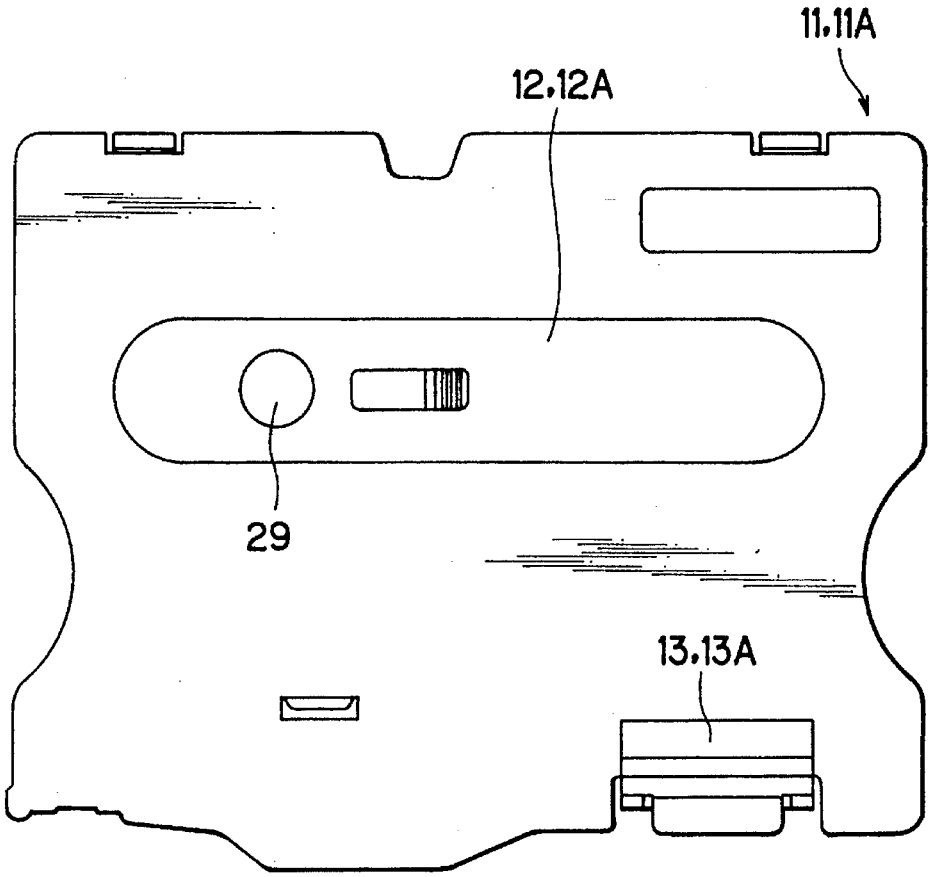
FIG. 6 is a plan view showing a cassette lid according to the first embodiment.
Figure 7:
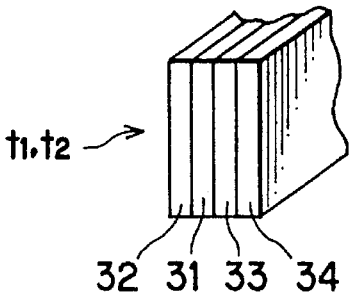
FIG. 7 is an explanatory diagram showing a construction of a tape.

Referring first to the common arrangement of the broad width tape cassette T2 and the small width tape cassette T1 with reference to FIGS. 5 through 7, in FIG. 5, a tape accommodating portion 21, 21A is provided at an upper left portion of the cassette body 10, 10A, and a tape support shaft 22, 22A (see FIGS. 9 and 11) protrudes from a bottom wall at a center portion of the tape accommodating portion 21, 21A. A tape spool 23, 23A formed with a spool bore 24, 24A is rotatably disposed over the tape support shaft 22, 22A for taking up the tape t1,t2. The tape t1,t2 taken up by the tape spool 23, 23A is guided by tape guides 25, 26, 27, 28 and is fed toward the tape outlet portion A. The tape drive roller 19 is rotatably provided in the tape cassette T1, T2. The tape drive roller 19 is adapted to drive a tape t1,t2 of the tape cassette T1, T2 in cooperation with the supplemental tape drive roller (not shown) disposed in the tape printer and positioned in confrontation with the tape drive roller 19 when the tape cassette T1, T2 is installed in the cassette installing portion 1. The tape t1,t2 is fed outside of the tape cassette T1, T2 at a position adjacent to the tape outlet portion A by co-operation of the tape feed shaft 18 fixed to the tape drive shaft 2, the tape drive roller 19 engaged with the tape feed shaft 18, and the above-described supplemental tape drive roller.

A recess B is formed at a position adjacent to the tape guide 28. The recess B is adapted to allow the thermal head TH projecting in the tape cassette installing portion 1 to be positioned in the recess B, when the tape cassette T1, T2 is installed in the cassette installing portion 1. The tape t1,t2, thus driven, is printed with characters, etc., by the thermal head TH, and is then discharged by the tape drive roller 19, etc. The silencer spool 20 is disposed in the tape cassette T1, T2. The silencer spool 20 is fittable with the drive shaft 3 of the tape printer P.

Further, in FIG. 6, the tape acknowledging portion 12, 12A provided at the lid 11, 11A is provided with a visually observing portion 29 for observing a top surface of a cap 30, 30A (described later) fitted at a top of the tape spool 23, 23A. Through the visually observing portion 29, the cap 30, 30A provided at the top of the tape spool 23, 23A can be observed. Incidentally, the cap 30, 30A is added with an information indicative of a color generated by the tape t1,t2 wound over the tape spool 23.

Further, as shown in FIG. 7, the tape t1,t2 accommodated in the tape cassette T1, T2 provides multiple layer arrangement including a tape substrate 31, a heat sensitive layer 32 formed on one surface of the tape substrate 31 for producing a color upon heating by the thermal head TH, an adhesive layer 33 formed on an opposite surface of the tape substrate 31, and a peelable tape 34 formed on the adhesive layer 33. For producing a character printed-tape in using such a tape t1, t2, selective heat control is carried out with respect to the heat sensitive layer 32 by the thermal head TH, so that colored characters etc. are formed on the heat sensitive layer 32.

Incidentally, the tape t1,t2, thus constructed, is wound over the tape spool 23 in such a manner that the heat sensitive layer 32 is positioned radially inwardly. With this winding, the heat sensitive layer 32 can be protected against heat and light, etc.

Next, the tape spool 23 and the tape t2 accommodated in the tape accommodating portion 21 of the cassette body 10 of the broad tape cassette T2 will be described with reference to FIGS. 8 and 9. In these drawings, the tape spool bore 24 is formed at a center of the tape spool 23, the bore 24 having an inner diameter of L2. Further, the tape support shaft 22 extending from the bottom wall of the cassette body 10 has an outer diameter of L1. The outer diameter L1 is smaller than the inner diameter L2, and therefore, a hollow cylindrical space S1 is defined between an outer peripheral surface of the tape support shaft 22 and the bore surface.

The cap 30 is fitted over the top of the tape spool 23 and is inserted into the space S1. Here, the wall thickness of the cap 30 is set to approximately (L2–L1)/2 so as to be inserted into the space S1 yet the tape spool 23 is still rotatable around the tape support shaft 22. The cap 30 has a disc like head portion and a hollow cylindrical portion. The latter has an axial length approximately equal to an axial length of the tape support shaft 22.

Figure 8:
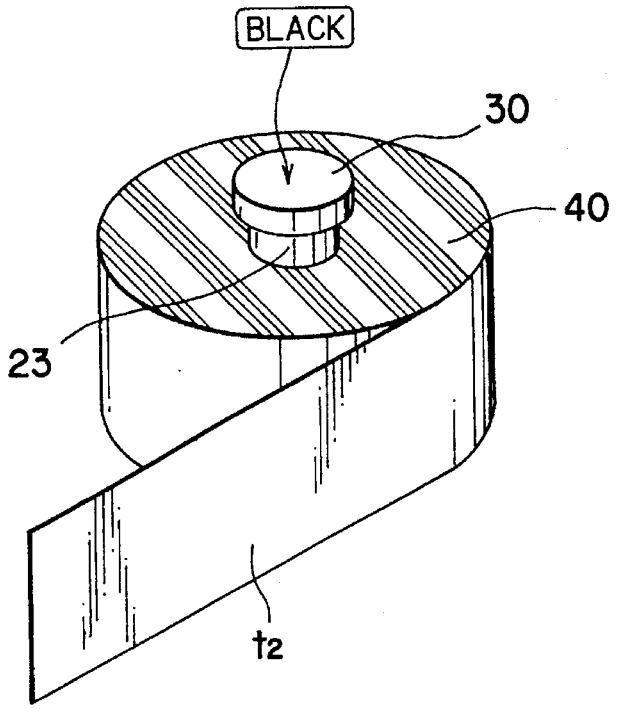
FIG. 8 is a perspective view showing a tape winding state of a broad width tape relative to a tape spool for use in the broad width tape cassette.
Figure 9:
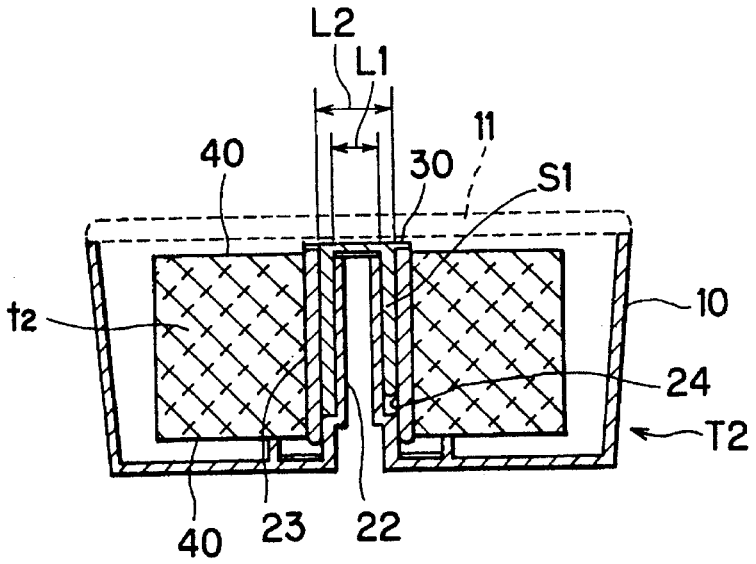
FIG. 9 is a schematic cross-sectional view showing the broad width tape cassette accommodating therein the tape roll.

As shown in FIG. 8, a character color generated by the tape t2 wound over the tape spool 23 is displayed on the top surface of the cap 30. As described above, the top surface of the cap 30 can be observed from outside of the tape printer P through the visually observing portion 29 at the acknowledging portion 12 provided at the cassette lid 11 and the window 7 of the lid 6. Thus, color of the printed character provided by the tape t2 accommodated in the tape cassette T2 can be easily acknowledged from outside.

Furthermore, seals 40 are adhesively bonded to upper and lower surfaces of a roll of the tape t2, with adhesive coating surfaces of the seals 40 being on the upper and lower surfaces thereof. (In FIG. 8, only the upper seal 40 is shown which is adhesively bonded to the upper surface of the tape roll. These seals 40 are adapted to prevent the tape t2 from being unwound from the tape spool 23 for maintaining tape winding state.

Next, will be described the tape spool 23A and the tape t1 accommodated in the tape accommodating portion 21 of the cassette body 10A of the small width tape cassette T1 with reference to FIGS. 10 and 11. In these drawings, the tape spool bore 24A is formed at a center of the tape spool 23A, the bore 24A having an inner diameter of L2. An axial length of the tape spool 23A is made smaller than that of the tape spool 23 of the broad width tape cassette T2. Further, the tape support shaft 22A extending from the bottom wall of the cassette body 10A has an outer diameter of M1. The axial length of the tape support shaft 22A is smaller than that of the tape support shaft 22 of the broad width tape cassette T2.

The cap 30A is fitted over the top of the tape spool 23A and is inserted into a space S2 defined by the difference between the inner diameter L2 of the spool bore 24A and the outer diameter M1 of the tape support shaft 22A. Here, the wall thickness of the cap 30A is set to approximately (L2–M1)/2 so as to be inserted into the space S2 yet the tape spool 23A is still rotatable around the tape support shaft 22A. The cap 30A has a head portion and a hollow cylindrical portion whose axial length is approximately the same as that of the tape support shaft 22A. That is, the axial length of the hollow cylindrical portion of the cap 30A is made smaller than that of the hollow cylindrical portion of the cap 30.

Here, the inner diameter L2 of the tape spool 23A of the small width tape cassette T1 is made equal to the inner diameter L2 of the tape spool 23 of the broad tape cassette T2. Further, the outer diameter M1 of the tape support shaft 22A of the small width tape cassette T1 is made smaller than the outer diameter L1 of the tape support shaft 22 of the broad tape cassette T2. Accordingly, a radial length of the space S2 defined between the tape spool 23A and the tape support shaft 22A of the small width tape cassette T1 is greater than that of the space S1 defined between the tape spool 23 and the tape support shaft 22 of the broad tape cassette T2. Because of the difference between the space S1 and S2, the wall thickness of the cap 30A to be fitted in the space S2 is greater than that of the cap 30 to be fitted in the space S1. As a result, the cap 30A to be employed for the small width tape cassette T1 cannot be fitted into the space S1 of the broad width tape cassette T2. Consequently, it is possible to prevent the cap 30A for the small width tape cassette T1 to be accidentally fitted in the space S1 of the broad width tape cassette T2.

Further, since the wall thickness of the cap 30 for the broad width tape cassette T2 is made smaller than the space S2 of the small width tape cassette T1, the cap 30 can be insertable into the space S2. However, in this case, the cap 30 is projected from the cassette body 10A, since the axial length of the hollow cylindrical portion of the cap 30 is greater than the axial length of the space S2, and since the roll of the tape t2 is projected out of the cassette body 10A because of the difference in width of the tapes t1 and t2. Accordingly, the cassette lid 11 cannot be engaged with the cassette body 10A for assembly. Therefore, in the latter case, also, it is possible to prevent the tape spool 23 for the broad width tape cassette T2 to be accidentally fitted with the tape support shaft 22A of the small width tape cassette T1. Consequently, each tape spool 23, 23A can be ultimately correctly assembled in corresponding one of the broad width tape cassette T2 and the small width tape cassette T1.

Figure 10:
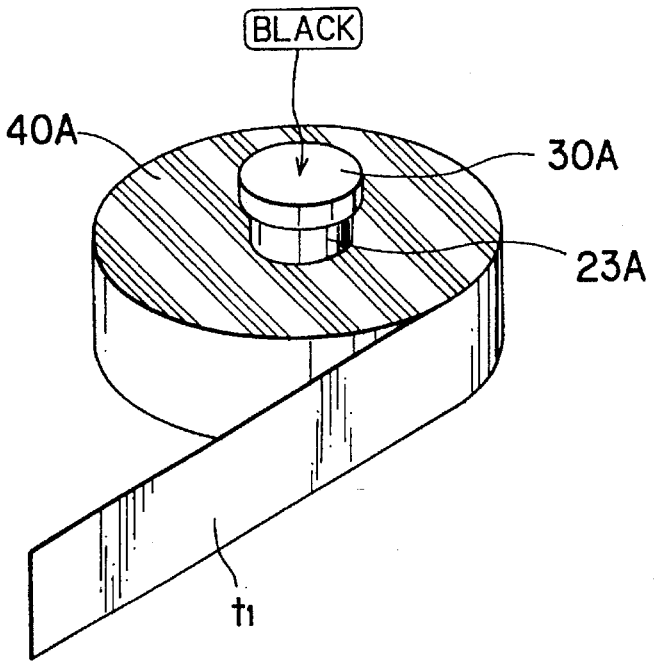
FIG. 10 is a perspective view showing a tape winding state of a small width tape relative to a tape spool for use in the small width tape cassette.
Figure 11:
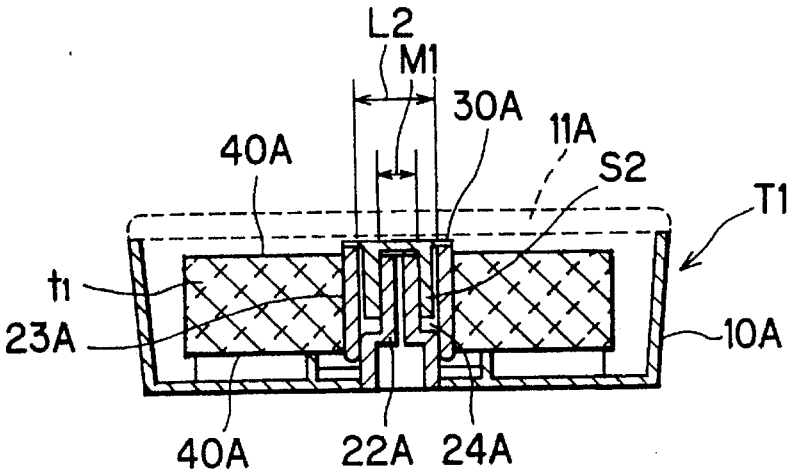
FIG. 11 is a schematic cross-sectional view showing the small width tape cassette accommodating therein the tape roll.

As shown in FIG. 10, a character color generated by the tape t1 wound over the tape spool 23A is displayed on the top surface of the cap 30A in a manner the same as the cap 30 for the roll of the tape t2. Further, as shown in FIG. 10, seals 40A are adhesively bonded to upper and lower surfaces of a roll of the tape t1, in a manner and purpose the same as the seals 40 for the roll of the tape t2.

If the tape t2 or t1 wound over the tape spool 23 or 23A accommodated in the tape cassette T2 or T1 has been used up, the used-up roll of the tape t2, or t1 must be exchanged for a new roll of the tape t2 or t1 wound over the spool 23 or 23A. In the exchange, first, the lid 6 is opened by rotating the rotary locking member 8 of the tape printer P so as to disassemble the tape cassette T1 or T2 from the tape cassette installing portion 1. Then, the cassette lid 11 or 11A is disengaged from the cassette body 10 or 10A through the engagement portion 13 or 13A. The tape spool 23 or 23A can be removed from the tape accommodating portion 21, 21A of the cassette body 10 or 10A.

Then, the cap 30 or 30A is pulled out from the space S1 or S2, and then, the tape spool 23 or 23A is disengaged from the tape support shaft 22 or 22A. Then, a new roll of the tape t2 or t1 wound over the tape spool 23 or 23A is attached to the tape support shaft 22 or 22A of the cassette body 10 or 10A. For the attachment, after the tape spool 23 or 23A is disposed over the tape support shaft 22 or 22A, the cap 30 or 30A is fitted in the space S1 or S2. In this case, the wall thickness of the cap 30 for use in the broad width tape cassette T2 corresponds to the space S1, and the wall thickness of the cap 30A for use in the small width tape cassette T1 corresponds to the space S2. Accordingly, as described above, it is possible to prevent the cap 30 from being erroneously attached to the unwanted small width tape cassette T1.

After the new tape spool 23 or 23A is accommodated in the tape accommodating portion 21, 21A of the tape cassette T2 or T1 and the tape t2 or t1 is guided to the tape outlet portion A through the tape guides 25, 26, 27 and 28, the cassette lid 11 or 11A is engaged with the cassette body 10 or 10A. Thus, new tape accommodation with respect to the tape cassette T2 or T1 is completed. Thus tape cassette T2 or T1 is installed in the cassette installing portion 1 for new printing work using the tape printer P.

A tape cassette according to a second embodiment of the present invention will next be described with reference to FIGS. 12 to 15. Cassette bodies 110, 110A and integral tape support shafts 122, 122A of the second embodiment are approximately the same as or can be identical to the cassette bodies 10, 10A and the tape support shafts 22, 22A of the first embodiment. The second embodiment differs from the first embodiment in tape spools 123, 123A.

Figure 12:
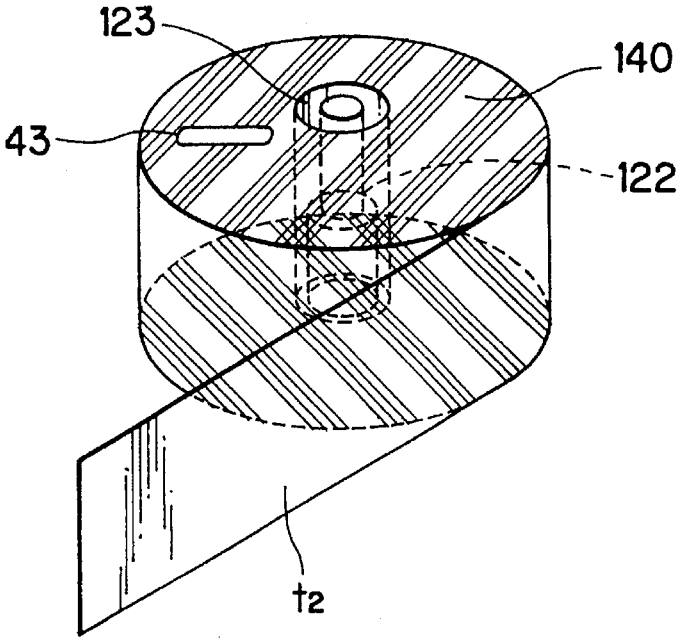
FIG. 12 is a perspective view showing a tape winding state of a broad width tape relative to another tape spool for use in a broad width tape cassette according to a second embodiment of the present invention.
Figure 13:
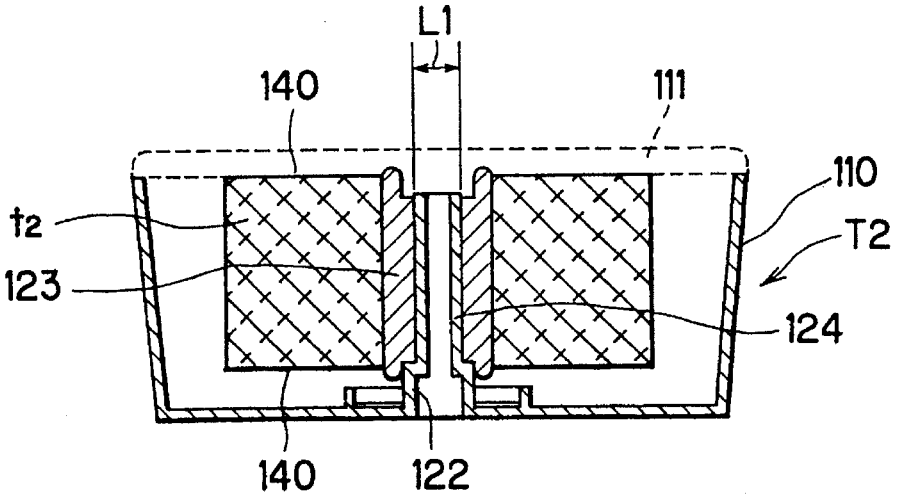
FIG. 13 is a schematic cross-sectional view showing a broad width tape cassette accommodating therein a tape roll in the second embodiment.

First, the tape spool 123 and the tape t2 capable of being accommodated in the tape accommodating portion of the broad width tape cassette T2 will be described with reference to FIGS. 12 and 13.

In these drawings, an inner diameter of a spool bore 124 formed at a central portion of the tape spool 123 is set to L1. Further, an outer diameter of the tape support shaft 122 upstanding from the bottom wall of the cassette body 110 is set approximately to L1, yet the tape spool 123 is still rotatable about the tape support shaft 122. Upper and lower faces of a roll of the tape t2 are affixed with seals 140 coated with adhesive material in such a manner that the adhesive layers of the seals are adhered to the upper and the lower faces (in FIG. 12, only the seal 140 affixed to the upper face of the tape roll is shown). These seals 140 are adapted to prevent the tape t2 from being unwound from the tape spool 123 and to maintain a rolling state, similar to the above described seals. Further, a display portion 43 is provided at the seal 140 affixed to the upper face of the tape roll t2 as shown in FIG. 12 so as to display a color, etc. generated by the tape t2. Accordingly, in changing the tape roll t2, the kind of the tape t2 can be acknowledged with the display portion 43, so that a correct tape t2 can be refilled without fail within the tape cassette T2.

Figure 14:
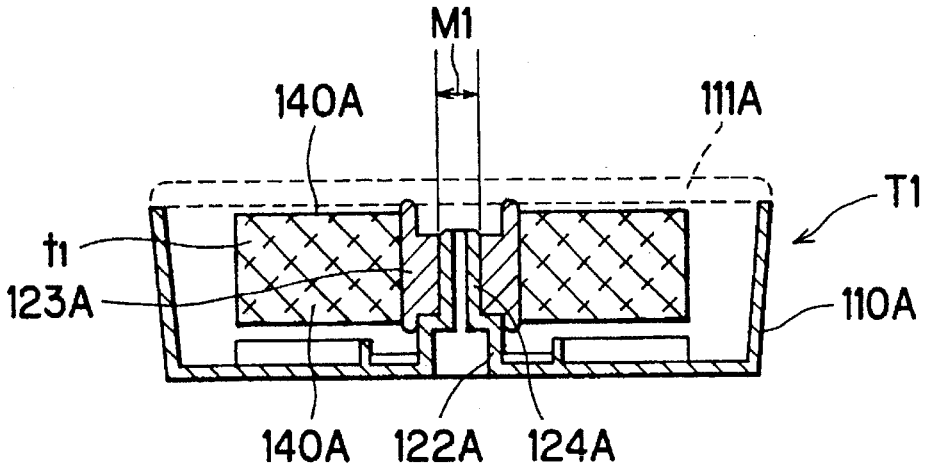
FIG. 14 is a schematic cross-sectional view showing a small width tape cassette accommodating therein a tape roll in the second embodiment.

Next, the tape spool 123A and the tape t1 capable of being accommodated in the tape accommodating portion of the small width tape cassette T1 will be described with reference to FIG. 14. An inner diameter of a spool bore 124A formed at a central portion of the tape spool 123A is set to M1. Further, an outer diameter of the tape support shaft 122A upstanding from the bottom wall of the cassette body 110A is set approximately to M1 (in such a manner that the tape spool 123A is still rotatable about the tape support shaft 122A).

Figure 15:
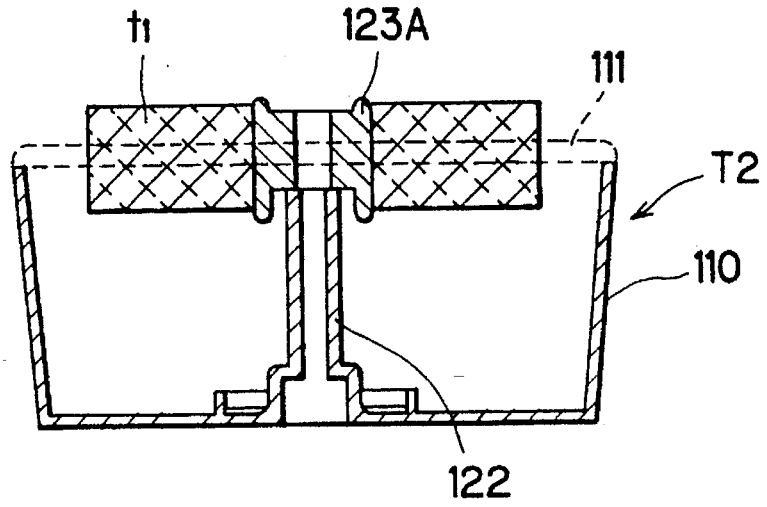
FIG. 15 is an explanatory diagram showing the accommodating condition of the tape spool for the small width tape cassette into the broad width tape cassette in the second embodiment.

Here, M1 (the inner diameter of the tape spool bore 124A and the outer diameter of the tape support shaft 122A of the small width tape cassette T1) is made smaller than L1 (inner diameter of the tape spool bore 124 and the outer diameter of the tape support shaft 122 of the broad width tape cassette T2). Accordingly, if the tape spool 123A for the small width tape cassette T1 is intended to be fitted over the tape support shaft 122 of the broad width tape cassette T2, as shown in FIG. 15, the tape spool 123A for the small width tape cassette T1 cannot be fitted over the tape support shaft 122 of the broad width tape cassette T2. Consequently, it is possible to prevent the tape spool 123A to be accidentally fitted over the tape support shaft 122 of the broad width tape cassette T2.

Further, since the inner diameter L1 of the spool bore 124 of the tape spool 123 of the broad width tape cassette T2 is made greater than the outer diameter M1 of the tape support shaft 122A of the small width tape cassette T1, the tape spool 123 for the broad width tape cassette T1 can be filled over the tape support shaft 122A of the small width tape cassette T1. However, in this case, the tape spool 123 is projected from the cassette body 110A, since axial length of the tape spool 123 is greater than a width of the small width tape t1. Therefore, the cassette lid 111a cannot be engaged with the cassette body 110A. Therefore, in the latter case, it is also possible to prevent the tape spool 123 for the broad width tape cassette T2 to be accidentally fitted with the tape support shaft 122A of the small width tape cassette T1. Consequently, each tape spool 123, 123A winding thereover the corresponding tapes t2, t1 can be correctly assembled in corresponding one of the broad width tape cassette T2 and the small width tape cassette T1.

Further, upper and lower faces of a roll of the tape t1 are affixed with seals 140A in a manner and object the same as that of the seals 140. Further, a display portion (not shown) is provided at the upper seal 140A for indicating the kind of the tape t1, to thus facilitating tape changing work similar to the display portion 43.

Similar to the first embodiment, the lid 111 or 111A is removed from the cassette body 110 or 110A for exchanging the roll of the tape t2 or t1 with a new roll of the tape. Then, the tape spool 123 or 123A is directly disengaged from the tape support shaft 122 or 122A. Thus, the used up roll of the tape t2 or t1 is removed from the cassette body 110 or 110A. Then a new roll of the tape t2 or t1 is assembled. That is, the tape spool 123 or 123A is directly fitted over the tape support shaft 122 or 122A. In this case, the inner diameters L1 and M1 of the spool bore 124, 124A respectively correspond to the outer diameters L1, M1 of the tape support shafts 122, 122A. Therefore, as described above, it is possible to prevent the tape spool 123 from being erroneously attached to unwanted tape cassette T1. Then, the tape t2 or t1 is positioned in a correct tape path and the lid 111 or 111A is engaged with the cassette body 110 or 110A.

In summary, in the present invention, the outer contour characteristic such as the diameter of the tape support shaft of each kind of tape cassette corresponds to the inner contour characteristic such as the inner diameter of the tape spool for the same type of tape cassette. This correspondence provides optimum size relation between the outer diameter of the tape support shaft and the inner diameter of the tape spool, i.e, not too tight for allowing the tape spool to be still rotatable about the tape support shaft, and not too loose for avoiding rattling of the tape spool against the tape support shaft. Either a non-corresponding tape spool cannot be mounted on a tape support shaft of a cassette body because its inner diameter is too small, or alternatively, if mountable, the improper tape spool will rattle after being mounted on the tape support shaft because its inner diameter is too large. Therefore, the user can notice the improper selection of the tape spool relative to the tape cassette body.

As described in detail, in the tape cassette of the present invention, if the tape wound over the tape spool is used up, new tape spool winding thereover a new tape can be refilled into the tape cassette. Further, in the refilling work, erroneous assembly of the tape spool with respect to the tape cassette can be prevented, and correct tape spool can be assembled into the corresponding tape cassette. Accordingly, wastage of the tape cassette can be avoided, and running cost in making the character-printed tape can be reduced.

While the invention has been described in detail with reference to the specific embodiments thereof, it would be apparent to those skilled in the art that various changes and modifications may be made therein without departing from the spirit and scope of the invention. For example, in the first embodiment, the cap 30 or 30A is detachable. However, the cap 30 or 30A can be fixed to the tape spool 23 or 23A, and the dimensional relationship between the inner diameter of the cap 30 or 30A and the outer diameter of the tape support shaft M1 or L1 is properly determined so as to allow the cap to be rotatable about the tape support shaft 22 or 22A. Further, the cap 30 or 30A can be provided integrally with the spool 23 or 23A.

Furthermore, the above description concerns the tapes of different width. However, the inventive concept can be applied to the tapes of different colors or other different factors. In the latter cases, even if the different tapes have identical width with each other, the correct spool can be assembled to the corresponding tape cassette body by making correspondence. That is, the outer contour characteristic, for example, the outer diameter of the tape support shaft of each kind of tape cassette corresponds to the inner contour characteristic, for example, the inner diameter of the tape spool bore for the same type of tape cassette, so that a correspondence between the outer and inner contour characteristics provides a relation with respect to an identical kind, and the relation being different from that in the different kind of the tape cassette.

What is claimed is:

1. A plurality of different kind of tape cassettes, each tape cassettes comprising:

a tape spool winding thereover a tape, the tape spool being formed with a bore defining an inner contour characteristic;

a cassette body for accommodating therein the tape spool and a roll of the tape;

a tape support shaft upstanding from the cassette body and having an outer contour characteristic, the tape spool being adapted for being rotatably disposed around the tape support shaft through the spool bore;

the outer contour characteristic of the tape support shaft of each kind of tape cassette corresponding to the inner contour characteristic of the tape spool bore for the same type of tape cassette, so that a correspondence between the outer and inner contour characteristics provides a relation with respect to an identical kind of tape cassette, and the relation being different from that in the different kind of the tape cassette.

2. The plurality of different kind of tape cassettes as claimed in claim 1, wherein the outer contour characteristic is an outer diameter of the tape support shaft, and the inner contour characteristic is an inner diameter of the spool bore.

3. The plurality of different kind of tape cassettes as claimed in claim 2, wherein the kind of the tape cassettes pertains to width of the tapes.

4. The plurality of different kind of tape cassettes as claimed in claim 3, wherein the plurality of tape cassettes comprise at least a first tape cassette accommodating a first tape kind, and a second tape cassette accommodating a second tape kind, a width of the first tape kind being greater than that of the second tape kind, an inner diameter of the spool bore of the second tape cassette being made smaller than an outer diameter of the tape support shaft of the first tape cassette for preventing the tape spool of the second tape cassette from being accidentally disposed around the tape spool shaft of the first tape cassette.

5. The plurality of different kind of tape cassettes as claimed in claim 4, wherein each roll of the tape has upper and lower faces, and further comprising first protective sheet adhesively fixed to the upper face and a second protective sheet adhesively fixed to the lower face.

6. The plurality of different kind of tape cassettes as claimed in claim 5, further comprising a display portion attached to the first protective sheet for displaying a kind of the tape.

7. The plurality of different kind of tape cassettes as claimed in claim 2, wherein the kind of the tape cassettes pertains to colors of the tapes.

8. The plurality of different kind of tape cassettes as claimed in claim 7, wherein the plurality of tape cassettes comprise at least a first tape cassette accommodating a first tape kind, and a second tape cassette accommodating a second tape kind, a color generated from the first and second tape kinds being different from each other, an inner diameter of the spool bore of the second tape cassette being made smaller than an outer diameter of the tape support shaft of the first tape cassette for preventing the tape spool of the second tape cassette from being accidentally disposed around the tape spool shaft of the first tape cassette.

9. The plurality of different kind of tape cassettes as claimed in claim 7, wherein each roll of the tape has upper and lower faces, and further comprising first protective sheet adhesively fixed to the upper face and a second protective sheet adhesively fixed to the lower face.

10. The plurality of different kind of tape cassettes as claimed in claim 9, further comprising a display portion attached to the first protective sheet for displaying a kind of the tape.

11. The plurality of different kind of tape cassettes as claimed in claim 1, further comprising a plurality of lid members each detachably provided to each of the cassette bodies.

12. The plurality of different kind of tape cassettes as claimed in claim 1, further comprising a plurality of cap members each disposed between a space defined between the spool bore and the tape support shaft, the outer contour characteristic of the tape support shaft of each kind of tape cassette corresponding to the inner contour characteristic of the tape spool bore for the same type of tape cassette, so that a correspondence among the outer and inner contour characteristics and the cap member provides a relation with respect to an identical kind of tape cassette, and the relation being different from that in the different kind of the tape cassette.

13. The plurality of different kind of tape cassettes as claimed in claim 12, wherein the outer contour characteristic is an outer diameter of the tape support shaft, and the inner contour characteristic is an inner diameter of the spool bore.

14. The plurality of different kind of tape cassette as claimed in claim 13, wherein the tape cassettes comprise at least a first tape cassette and a second tape cassette, and the cap members comprise at least first and second cap members, and wherein the inner diameter of the tape spool of the first tape cassette is equal to the inner diameter of the tape spool of the second tape cassette, and the outer diameter of the tape support shaft of the first tape cassette is different from an outer diameter of the tape support shaft of the second tape cassette, so that a first space is defined between the tape support shaft and the tape spool in the first tape cassette and a second space is defined between the tape support shaft and the tape spool in the second tape cassette, the first cap being positionable only in the first space and a second cap being positionable only in the second space.

15. The plurality of different kind of tape cassettes as claimed in claim 14, wherein first cap member comprises a first head portion and a first hollow cylindrical portion provided integrally therewith, and the second cap member comprises a second head portion and a second hollow cylindrical portion provided integrally therewith, and axial length of the first hollow cylindrical portion being approximately equal to that of the first space, and axial length of the second hollow cylindrical portion being approximately equal to that of the second space.

16. The plurality of different kind of tape cassettes as claimed in claim 15, wherein each roll of the tape has upper and lower faces, and further comprising first protective sheet adhesively fixed to the upper face and a second protective sheet adhesively fixed to the lower face.

17. The plurality of different kind of tape cassettes as claimed in claim 16, further comprising display portions each attached to each of the head portions of the cap members for displaying a kind of the tape.

18. The plurality of different kind of tape cassettes as claimed in claim 14, wherein the kind of the tape cassettes pertains to width of the tapes.

19. The plurality of different kind of tape cassettes as claimed in claim 18, wherein the first tape cassette is accommodating a first tape kind and the second tape cassette is accommodating a second tape kind, a width of the first tape kind being greater than that of the second tape kind, and wherein the first hollow cylindrical portion of the first cap member has a first radial thickness, and the second hollow cylindrical portion of the second cap member has a second radial thickness, the first radial thickness being made smaller than the second radial thickness for preventing the second cap member from being inserted into the first space.

* * * * *